United States Patent [19]

Cortesi

[11] Patent Number: 4,834,384

[45] Date of Patent: May 30, 1989

[54] GAME AND APPARATUS FOR PLAYING THE GAME

[76] Inventor: Roy L. Cortesi, P.O. Box 453, Greenville, Miss. 38702

[21] Appl. No.: 4,603

[22] Filed: Dec. 9, 1986

[51] Int. Cl.[4] ..... A63F 7/00; A63D 15/00

[52] U.S. Cl. ..... 273/123 R; 273/3 A; 273/118 R

[58] Field of Search ..... 273/3 A, 123 R, 3 R, 273/126 R, 118 R, 119 R

[56] References Cited

U.S. PATENT DOCUMENTS

| | | | |
|---|---|---|---|
| 1,693,116 | 11/1928 | Lee | 273/3 A |
| 2,005,660 | 6/1935 | Maxwell | 273/123 R |
| 3,360,265 | 12/1967 | Yabroudy | 273/3 R |
| 3,797,627 | 3/1974 | Baker | 273/11 C |
| 4,526,368 | 7/1985 | Furda | 273/14 |

FOREIGN PATENT DOCUMENTS

| | | | |
|---|---|---|---|
| 757108 | 6/1933 | France | 273/3 R |

*Primary Examiner*—Richard C. Pinkham
*Assistant Examiner*—Gary Jackson
*Attorney, Agent, or Firm*—Berman, Aisenberg & Platt

[57] ABSTRACT

A game is played on a table having a polygonal playing surface from which an elongated rolling area extends, and spaced apart pockets are located in the perimeter of the playing surface, the pockets extending beneath the playing surface communicating with channels for returning balls to one end of the table. Balls are projected by hand onto the table in a game in which the winning ball, which may be marked with a numerical value, is the ball which remains closest to a zero ball situated at a predetermined point on the table at the start of the game. The equipment may be coin-operated.

17 Claims, 1 Drawing Sheet

GAME AND APPARATUS FOR PLAYING THE GAME

FIELD OF THE INVENTION

The invention relates to games and equipment for playing games, particularly game tables.

BACKGROUND OF THE INVENTION

The game described is related to the game of bocci (an Italian variation on lawn bowling) and to table games such as pool, billiards or snooker in which balls are directed with a cue. Related games are described in U.S. Pat. Nos. 1,693,116, 3,797,627, 3,958,804 and 4,526,368. A game in which players project pieces, such as marbles, on to a board is described in U.S. Pat. No. 1,757,870. U.S. Pat. No. 3,360,265 describes a simulated golf course having game tables of different shapes (instead of golf course greens), on which a game based on golf using one ball struck by a billiard-type cue is played.

Bocci is a known lawn bowling game wherein balls are paleen or dope determining which balls are closer to the paleen or dope ball and by awarding points to the player having balls closer to the paleen or dope ball. On the Bauchoa Table the balls are projected towards a zero ball.

SUMMARY OF THE INVENTION

A game in accordance with the invention is played on a table comprising a horizontal playing surface having a polygonal playing portion and an elongated rolling portion extending outwardly from one said of the polygonal playing portion. Upstanding rails extend around the perimeter of the playing surface, and a plurality of pockets extend downwardly from the playing portion adjacent the rails. The pockets communicate with channels for returning balls to a rolling area.

The game is played by two or more players who project balls in turn onto the playing surface, by hand, from the rolling area. The balls are assigned different numerical values for scoring.

It is an object of the invention to provide a novel apparatus for playing a game.

It is another object of the invention to provide a new and interesting game for a plurality of players.

BRIEF DESCRIPTION OF THE DRAWINGS

The FIGURE is a perspective view of a table and balls in accordance with the invention, set up and ready for play.

DETAILED DESCRIPTION OF THE INVENTION

Figure 1:
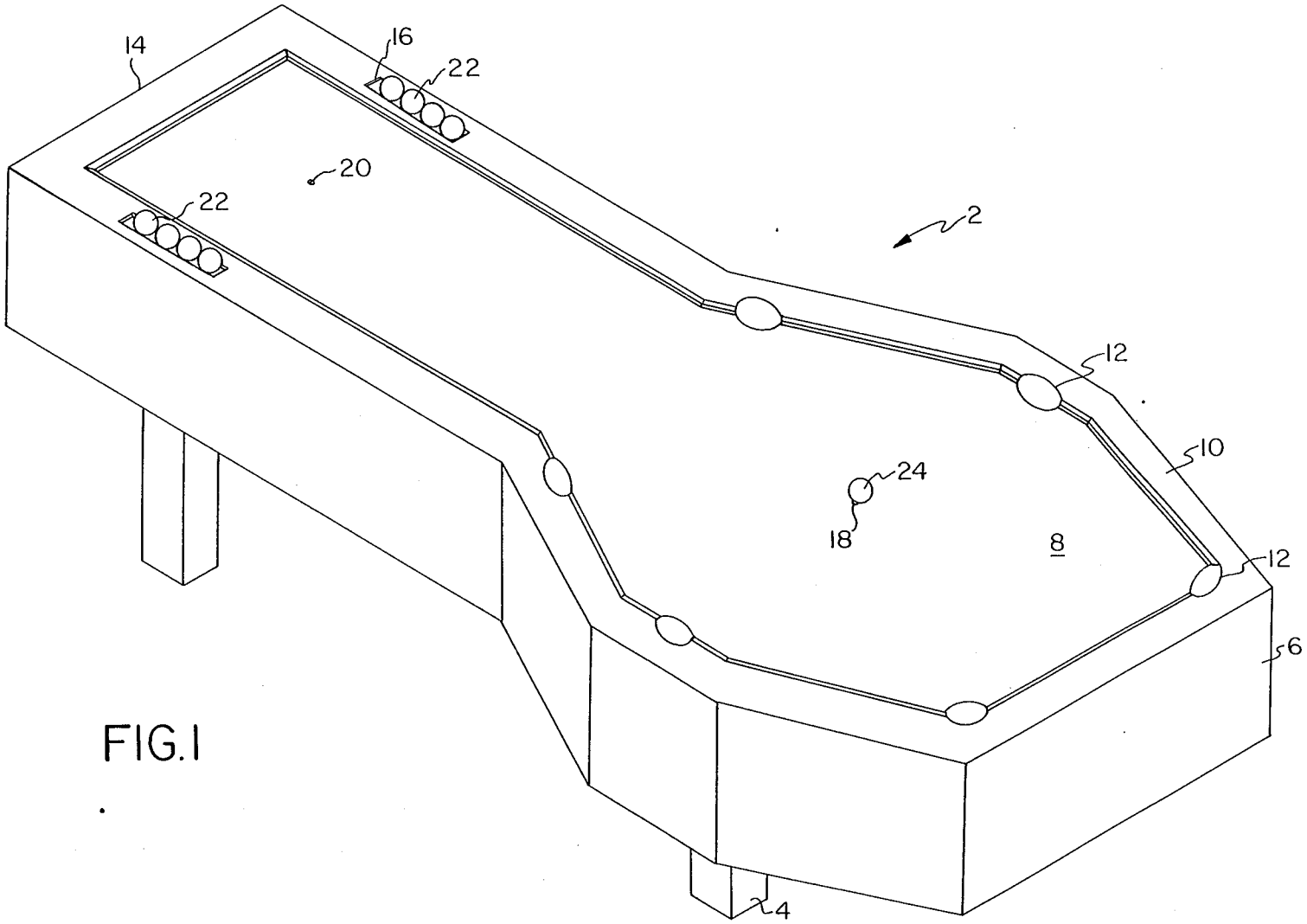

In the game of the invention balls (or other playing objects) are projected by hand onto a table toward a zero ball which has been placed in a predetermined location. The table of the invention has a horizontal playing surface, an upstanding rail around the playing surface, and pockets at the rail edge extending beneath the playing surface. The playing surface has a novel polygonal playing portion, and balls are projected from an elongated rolling portion which extends outwardly from one side of the polygonal playing portion. the rolling portion is preferably rectangular and the polygon is preferably irregular.

Players project balls by hand, from a rolling area located at the end of the elongated rectangular rolling portion remote from the playing portion, the balls being projected toward the polygonal playing portion which extends from the opposite end of the rectangular rolling portion. Pockets are spaced apart along the perimeter of the playing portion, and channels below the table extend from each pocket to the rolling area for returning balls received in the pockets to the rolling end of the table.

The game may be coin operated, as also described in U.S. Pat. No. 3,797,627. Access doors for the coin mechanism and ball return mechanism are provided in the table, preferably at the rolling end.

Referring to the figure, table 2 has legs 4 which support table body 6. A playing surface 8 lies on top of body 6, and side rails 10 extend around the playing surface. Pockets 12 are spaced from each other at intervals around the edge of the playing surface and connect to channels (not shown) for returning balls to rolling end 14 of table 2. Ball racks 16 are provided on respective sides of table 2 adjacent rolling end 14, for holding balls 22. A ball return area and coin slot are recessed into the table at the rolling end 14, in a conventional manner as shown, for example, in U.S. Pat. No. 3,797,627. Other structures for ball return and coin operation may be used.

The playing surface is preferably a felt-covered horizontal surface and, the playing portion is marked with indicia, preferably a black dot 18, in about the center of the polygonal playing portion. A zero ball 24 is placed, at the beginning of the game, on the black dot 18. Another indicia, such as black dot 20, is on the rolling portion near the rolling end, to mark the point behind which the balls 22 must be projected when in play.

The figure illustrates a preferred octagonal playing area abutting a rectangular rolling area, in a non-limiting example of a table of the invention. In this preferred example, six pockets 12 are spaced apart around the perimeter of the playing surface. One pocket is at each of four corners of the playing surface opposite from the rolling end, and one is in the center of each of the central, shorter sides 24 of the octagon. These central shorter sides are substantially parallel to, but spaced further apart than, the parallel sides of the rolling area.

The dimensions of the table are chosen according to known criteria. Preferred dimensions of the table are, for example: height (to the top of the side rails), 2 ft. 8 in.; length, 9 ft. 9 in.; length of the rolling portion, 4 ft.; interior width of the rolling portion, 2 ft.; and maximum interior width of the playing surface, 4 ft. 5 in. In this example, the length of the short opposite sides 24 of the octangonal playing area, having a pocket in the center of each, is 1 ft. Other appropriate shapes and sizes will be apparent to one skilled in the art.

The game is preferably played with balls, which may be of wood or plastic, between 2 in. and $2\frac{1}{2}$ in. in diameter. Zero ball 24 may be the same size as balls 22 in the playing sets of balls or may have a different diameter. Each player uses a set of balls of a color and/or marking which differs from those of the set of balls of each other player and from the zero ball. Each set of playing balls may comprise four balls, or any other appropriate number of balls. A set of four balls preferably has marked numerical values of 1, 2, 3 and 4. Each playing set of balls is equal in number and respective values to each other such set of balls.

The game is preferably played by two players, but may be played by three or four players. The zero ball is placed on black dot 18 and the first player projects one of his set of balls onto the table, by hand, either by throwing or by rolling (from rolling end 14 of table 2, behind black dot 20) toward the zero ball, the object being for the projected ball to stop as close as possible to the zero ball. The second or next player projects the first of his set of balls similarly toward the zero ball with the same objective. The players take turns in projecting balls until all the balls have been played, and the score is computed or the winner decided by ascertaining which ball is closest to the zero ball. A player may roll his ball and knock the zero ball anywhere in the octagonal area any time during game play.

If a ball rolls into a pocket, that ball is out of play for the rest of the game. A player may attempt to knock an opponent's ball either away from the zero ball, into a pocket, or into the rolling portion, which is also out of play. A ball landing in the rolling portion is removed from the table.

To determine the winner, the ball closest to the zero ball for one player is compared to the ball closest to the zero ball for a second player. The winner is the player whose ball has the higher numerical value. If there is a tie, the numerical value of the next closest ball is added to that player's score. If a tie remains, each player rolls the farthest ball again, and the numerical value of the closest re-rolled ball is added to that player's score.

In an alternative game, the player with a ball closest to the zero ball wins irrespective of the numerical value. If two players have balls at equal distances from the zero ball, the next-closest ball is determinative.

A player knocking the zero ball into a pocket or into the rolling area immediately loses that game.

The playing pieces are preferably balls, but the game may also be played using sliding discs, or other playing pieces.

The game table may be coin operated by conventional means, by which access to the balls is governed by coin operation. Coins must be inserted to access pocketed balls at the start of each game.

It will be appreciated that the shape of the described table uniquely cooperates with the balls in the playing of the game. By providing an octagonal shape, the manner in which a ball can be knocked out of play by an incoming ball is optimized to increase interest in the game. The use of shorter sides parallel to the rolling portion also increases the skill required to win the game and the enjoyment thereof.

While the invention has been described above with respect to certain embodiments thereof, it will be appreciated that various changes and modifications may be made without departing from the spirit and scope of the invention.

What is claimed is:

1. Apparatus for playing a game comprising a table having a horizontal polygonal playing surface comprising an unobstructed polygonal playing portion having more than four sides and an elongated rolling portion, said rolling portion being narrower than said playing portion, and extending outwardly from said playing portion with one side contiguous with one side of said playing portion, an upstanding rail extending around the perimeter of said playing surface, and a plurality of unobstructed spaced pockets only in said playing portion immediately adjacent said upstanding rail and extending below the playing surface.

2. Apparatus of claim 1 further comprising:

movable playing means for being projected onto the playing surface.

3. Apparatus of claim 2 wherein movable playing means comprises a plurality of pieces.

4. Apparatus of claim 3 wherein said pieces comprise a zero piece and a plurality of sets of pieces each of said sets having the same number of pieces.

5. Apparatus of claim 4 wherein each member of a set is marked with indicia of scoring value.

6. Apparatus of claim 4 wherein each set is of different color from each other set and from the zero piece.

7. Apparatus of claim 5 wherein each set is of different color from each other set and from the zero piece.

8. Apparatus of claim 3 wherein the pieces are balls.

9. Apparatus of claim 8 comprising a zero ball and a plurality of sets of balls of equal number each set being marked with indicia of scoring value, and each set being of different color from each other set and from the zero ball.

10. Apparatus according to claim 9 wherein said polygonal playing portion has several sides and said rolling portion has three sides.

11. Apparatus for playing a game comprising:

table means comprising a horizontal surface and ten side edges surrounded by an upstanding rail, wherein said side edges are joined together to form an unobstructed octagonal playing portion having one side contiguous to a side of a rectangular rolling portion which is narrower than said playing portion, said playing portion and rolling portion being included within the perimeter of said rail, and a plurality of unobstructed pockets abutting said rail and spaced about and only in said playing portion, said pockets extending beneath the playing surface of the table and communicating with channel means of returning balls entering said pockets to one end of the table, and playing means for being projected onto the rolling portion by hand, said playing means comprising a plurality of balls comprising one zero ball of a predetermiend color and at least two sets of balls of equal number, each set being of a color different from each other and from the zero ball.

12. Apparatus of claim 11 wherein the table means comprises six spaced pockets.

13. Apparatus of claim 11 wherein a numerical scoring value is marked on each ball.

14. Apparatus of claim 13 wherein each set comprises four balls.

15. Apparatus of claim 11 wherein the octagonal portion of the playing surface has two facing parallel side edges which are also parallel to two parallel side edges of the rectangular portion.

16. Apparatus of claim 15 wherein said two facing parallel side edges of the octagonal portion are equal in length and are shorter than other side edges of the octagonal portion.

17. Apparatus of claim 15 wherein one of said pockets is located in approximately the center of each of said facing parallel side edges.

* * * * *

UNITED STATES PATENT OFFICE

CERTIFICATE OF CORRECTION

Patent No. 4,834,384 Dated May 30, 1989

Inventor(s) CORTESI

It is certified that error appears in the above-identified patent and that said Letters Patent is hereby corrected as shown below:

Column 1, line 23, "are paleen" should read --are projected toward a paleen--, "dope" should read --dope ball. The game is scored by--; line 26, "Bauchoa" should read --Bauchaa--; line 64, "portion. the" should read --portion. The--. Column 3, line 13, "game play" should read --game--.

Signed and Sealed this

Twelfth Day of June, 1990

*Attest:*

HARRY F. MANBECK, JR.

*Attesting Officer*

*Commissioner of Patents and Trademarks*